US010539338B2

(12) United States Patent
Okamoto et al.

(10) Patent No.: US 10,539,338 B2
(45) Date of Patent: Jan. 21, 2020

(54) COMBUSTION DEVICE AND COMBUSTION DEVICE SYSTEM INCLUDING COMBUSTION DEVICE

(71) Applicant: NORITZ CORPORATION, Hyogo (JP)

(72) Inventors: Shinichi Okamoto, Kobe (JP); Takao Muko, Kobe (JP)

(73) Assignee: NORITZ CORPORATION, Hyogo (JP)

( * ) Notice: Subject to any disclaimer, the term of this patent is extended or adjusted under 35 U.S.C. 154(b) by 194 days.

(21) Appl. No.: 15/783,052

(22) Filed: Oct. 13, 2017

(65) Prior Publication Data

US 2018/0112890 A1 Apr. 26, 2018

(30) Foreign Application Priority Data

Oct. 25, 2016 (JP) ..... 2016-208833

(51) Int. Cl.
*F22B 35/00* (2006.01)
*F24H 9/20* (2006.01)
(Continued)

(52) U.S. Cl.
CPC ..... *F24H 9/2042* (2013.01); *F23C 6/02* (2013.01); *F23J 11/12* (2013.01); *F23N 5/265* (2013.01);
(Continued)

(58) Field of Classification Search
CPC ... F27B 13/02; F22B 35/008; F24D 2200/043
See application file for complete search history.

(56) References Cited

U.S. PATENT DOCUMENTS 4,337,893 A * 7/1982 Flanders ..... F24D 12/02 236/1 EB
4,637,349 A * 1/1987 Robinson ..... F24D 12/02 122/448.3
(Continued)

FOREIGN PATENT DOCUMENTS

JP 2002013701 A * 1/2002 ..... F24H 9/2042
JP 5852458 B2 2/2016
JP 2016-121851 A 7/2016

*Primary Examiner* — Gregory A Wilson
(74) *Attorney, Agent, or Firm* — Studebaker & Brackett PC

(57) ABSTRACT

A combustion device includes a combustion control section which controls combustion in the combustion device; a setting section operated to set information indicating whether or not a plurality of combustion devices are in a common vent discharge state; and a memory section which stores therein connection configurations with the other combustion control sections to which the combustion control section is communicatively connected, and the combustion control section determines whether or not the combustion control section can communicate with a linkage control section or the other combustion control sections, and inhibits combustion in the combustion device to which the combustion control section belongs, in a case where the combustion control section determines that the combustion control section cannot communicate with the linkage control section or at least one of the other combustion control sections and the common vent discharge state is set by the setting section.

6 Claims, 4 Drawing Sheets

(51) Int. Cl.

| | |
|---|---|
| ***F23J 11/12*** | (2006.01) |
| ***F23C 6/02*** | (2006.01) |
| ***F23N 5/26*** | (2006.01) |
| *F24H 1/00* | (2006.01) |
| *F24H 1/46* | (2006.01) |

(52) U.S. Cl.
CPC ..... *F23J 2211/20* (2013.01); *F23N 2031/28* (2013.01); *F23N 2037/02* (2013.01); *F23N 2041/04* (2013.01); *F24H 1/0027* (2013.01); *F24H 1/46* (2013.01)

(56) References Cited

U.S. PATENT DOCUMENTS 4,805,114 A * 2/1989 Putman ..... G06Q 50/06 705/412
4,864,972 A * 9/1989 Batey ..... F22B 35/008 122/448.3
7,506,617 B2 * 3/2009 Paine ..... F23N 1/082 122/448.3
8,371,252 B1 * 2/2013 Paine ..... F24H 9/2035 122/448.3
8,868,251 B2 * 10/2014 Hatada ..... F24H 1/10 219/200

* cited by examiner

| Combustion control section | Combustion control section 41 | Combustion control section 42 | Combustion control section 43 | ・・・ | Combustion control section 4n |
|---|---|---|---|---|---|
| Communication with linkage control section | Impossible | Possible | Possible | ・・・ | Possible |
| Section which inhibits combustion | Combustion control section 41 | linkage control section 12 | linkage control section 12 | ・・・ | linkage control section 12 |
| Inhibit or allow combustion | Inhibit | Inhibit | Inhibit | ・・・ | Inhibit |

Fig. 2

COMBUSTION DEVICE AND COMBUSTION DEVICE SYSTEM INCLUDING COMBUSTION DEVICE

CROSS-REFERENCE TO RELATED APPLICATION

This application claims priority to and the benefit of Japanese Patent Application No. 2016-208833 filed on Oct. 25, 2016, the entire disclosure of which is incorporated herein by reference.

1. FIELD OF THE INVENTION

The present invention relates to a combustion device and a combustion device system including the combustion device.

2. DESCRIPTION OF THE RELATED ART

Regarding a combustion device system in which a plurality of combustion devices such as combustion/heating type hot water supply devices are connected to each other, a common vent system is known, in which a common exhaust passage is used for the plurality of combustion devices. For example, Japanese Laid-Open Patent Application Publication No. 2016-121851 and Japanese Patent No. 5852458 disclose such a common vent system. In this common vent system, air-intake is performed in an indoor area, and an exhaust gas is discharged to an outdoor area through a common duct (common exhaust duct).

In a case where at least one of the plurality of combustion devices connected to the common duct is performing a combustion operation, an exhaust gas emitted from this combustion device may flow back through the common duct, from an exhaust side to an intake side of another combustion device in a deactivated (stopped) state (another combustion device which is not performing the combustion operation), and flow into the indoor area. To prevent this, in a case where at least one of the plurality of combustion devices connected to the common duct is performing the combustion operation, it is necessary to activate exhaust fans of the other combustion devices which are not performing the combustion operations. As measures taken to prevent the back flow of the exhaust gas, a back flow prevention mechanism such as a back flow prevention damper may be provided in a location between the exhaust passage of each of the combustion devices and the common duct. However, it is assumed that an incorrect operation of the back flow prevention mechanism occurs. Therefore, it is desirable to activate the exhaust fans of all of the plurality of combustion devices connected to the common duct.

SUMMARY OF THE INVENTION

However, if a communication abnormality (failure) between the plurality of combustion devices occurs, the existence of the combustion device which is performing the combustion operation cannot be detected by the other combustion devices. In this situation, after at least one of the plurality of combustion devices connected to the common duct has started the combustion operation, the exhaust fans of the other combustion devices cannot be activated. Therefore, in a case where the communication abnormality occurs, it is necessary to inhibit the combustion in all of the plurality of combustion devices connected to the common duct. In this case, for example, it is necessary to cease the combustion operations of all of the plurality of combustion devices.

In contrast, unlike the above-described case, in a case where the common exhaust passage is not used in the combustion device system including the plurality of combustion devices connected to each other, it is not necessary to activate the exhaust fans of the other combustion devices. If a failure occurs in one of the plurality of combustion devices and this combustion device cannot communicate with the other combustion devices, it is desired that the other combustion devices without an abnormality continue the combustion operations, to increase a time period for which the combustion operation in the whole of the system can be performed.

The present invention has been developed to solve the above-described problem, and an object of the present invention is to provide a combustion device which can realize proper combustion inhibiting operations of a plurality of combustion devices in a case where a communication abnormality (failure) between the plurality of combustion devices occurs in a case where a common exhaust passage is used for the plurality of combustion devices, and a combustion device system including this combustion device.

According to one aspect of the present invention, there is provided a combustion device included in a plurality of combustion devices used in a combustion device system in which a plurality of combustion control sections of the plurality of combustion devices are communicatively connected to each other via a linkage control section which controls linkage operations of the plurality of combustion devices, and a common exhaust passage can be used for the plurality of combustion devices, the combustion device comprising: the combustion control section which is one of the plurality of combustion control sections and controls combustion in the combustion device to which the combustion control section belongs; a setting section operated to set information indicating whether or not the plurality of combustion devices are in a common vent discharge state in which the common exhaust passage is used for the plurality of combustion devices; and a first memory section which stores therein connection configurations between the combustion control section and the other combustion control sections to which the combustion control section is communicatively connected, wherein the combustion control section determines whether or not the combustion control section can communicate with the linkage control section or the other combustion control sections, and inhibits combustion in the combustion device to which the combustion control section belongs, in a case where the combustion control section determines that the combustion control section cannot communicate with the linkage control section or at least one of the other combustion control sections and the common vent discharge state is set by the setting section.

In accordance with this configuration, in a case where a condition in which the information set by the setting section indicates the common vent discharge state and a condition in which the combustion control section cannot communicate with the linkage control section or at least one of the other combustion control sections are met, the combustion control section of each of the plurality of combustion devices inhibits the combustion in the combustion device to which this combustion control section belongs (combustion in the combustion device corresponding to this combustion control section). This makes it possible to reliably prevent a situation in which while one of the plurality of combustion devices is performing the combustion operation in the common vent discharge state, the operation commands for the exhaust fans of the other combustion devices do not reach the combustion devices and thereby back flow of the exhaust gas occurs. Therefore, it becomes possible to properly perform a combustion inhibiting operation of each of the plurality of combustion devices if a communication abnormality (failure) between the plurality of combustion devices occurs in a case where the common exhaust passage is used for the plurality of combustion devices.

The linkage control section may include an information obtaining section which obtains the information set by the setting section from at least one of the plurality of combustion devices; and a second memory section which stores therein connection configurations between the linkage control section and the plurality of combustion control sections, wherein the linkage control section may determine whether or not the linkage control section can communicate with each of the plurality of combustion control sections of the plurality of combustion devices, and send to the combustion control sections being in communication with the linkage control section, combustion inhibiting commands directing inhibition of combustion in the combustion devices corresponding to the combustion control sections being in communication with the linkage control section, in a case where the linkage control section determines that the linkage control section cannot communicate with at least one of the plurality of combustion control sections and the information obtained from the setting section indicates the common vent discharge state, and wherein the combustion control sections being in communication with the linkage control section may inhibit the combustion in the combustion devices to which the combustion control sections belong, in response to the combustion inhibiting commands received from the linkage control section. In accordance with this configuration, in a case where the combustion control section of a specified combustion device cannot communicate with the linkage control section, the linkage control section sends to the other combustion control sections being in communication with the linkage control section, the commands directing inhibition of the combustion in the combustion devices. The combustion control section of the specified combustion device which cannot communicate with the linkage control section inhibits the combustion in the specified combustion device, and the linkage control section sends the commands directing inhibition of the combustion in the other combustion devices to the corresponding combustion control sections. This makes it possible to reliably inhibit the combustion in the whole of the plurality of combustion devices in the common vent discharge state.

A first combustion control section which is one of the plurality of combustion control sections may be configured to function as the linkage control section, wherein the plurality of combustion control sections may be communicatively connected to each other via a communication line, wherein the communication line may include a first communication line used to send a signal from the first combustion control section to a second combustion control section which is another of the plurality of combustion control sections, and a second communication line which is different from the first communication line and is used to send the signal from the second combustion control section to the first combustion control section, and wherein the first combustion control section may inhibit the combustion in the combustion device to which the first combustion control section belongs and sends the combustion inhibiting command to the second combustion control section, in a case where the first combustion control section cannot receive the signal from the second combustion control section within a predetermined time period after the first combustion control section has sent the signal to the second combustion control section. In the case of occurrence of the communication abnormality (failure), the first combustion control section which cannot receive the signal and can send the signal inhibits the combustion in the combustion device corresponding to the second combustion control section to which the first combustion control section can send the signal, as well as the combustion in the combustion device corresponding to the first combustion control section. This makes it possible to properly inhibit the combustion in these combustion devices.

According to another aspect of the present invention, there is provided a combustion device system in which a plurality of combustion control sections of a plurality of combustion devices are communicatively connected to each other via a linkage control section which controls linkage operations of the plurality of combustion devices, and a common exhaust passage can be used for the plurality of combustion devices, the combustion device system comprising: the plurality of combustion control sections which are provided in the plurality of combustion devices, respectively, and control combustion in the plurality of combustion devices; the linkage control section communicatively connected to the plurality of combustion control sections; and a setting section provided in each of the plurality of combustion devices and operated to set information indicating whether or not the plurality of combustion devices are in a common vent discharge state in which the common exhaust passage is used for the plurality of combustion devices, wherein the linkage control section includes: an information obtaining section which obtains the information set by the setting section from at least one of the plurality of combustion devices; and a second memory section which stores therein connection configurations between the linkage control section and the plurality of combustion control sections of the plurality of combustion devices, wherein the linkage control section determines whether or not the linkage control section can communicate with each of the plurality of combustion control sections of the plurality of combustion devices, and sends to the combustion control sections being in communication with the linkage control section, combustion inhibiting commands directing inhibition of combustion in the combustion devices corresponding to the combustion control sections being in communication with the linkage control section, in a case where the linkage control section determines that the linkage control section cannot communicate with at least one of the plurality of combustion control sections of the plurality of combustion devices and the information obtained from the setting section indicates the common vent discharge state, and wherein the combustion control section of each of the plurality of combustion devices determines whether or not the combustion control section can communicate with the linkage control section or the other combustion control sections, and inhibits combustion in the combustion device to which the combustion control section belongs, in a case where the combustion control section determines that the combustion control section cannot communicate with the linkage control section or at least one of the other combustion control sections and the common vent discharge state is set by the setting section, or a case where the combustion control section receives the combustion inhibiting command from the linkage control section.

In accordance with this configuration, in a case where a condition in which the information set by the setting section indicates the common vent discharge state and a condition in which the combustion control section cannot communicate with the other combustion control sections are met, the combustion control section of each of the plurality of combustion devices inhibits the combustion in the combustion device to which this combustion control section belongs (the combustion in the combustion device corresponding to this combustion control section). Also, in a case where the combustion control section of a specified combustion device cannot communicate with the linkage control section, the linkage control section sends the commands directing inhibition of the combustion in the other combustion devices being in communication with the linkage control section, to the corresponding combustion control sections. In this way, the combustion control section of the specified combustion device which cannot perform the communication inhibits the combustion in the specified combustion device, and the linkage control section sends the commands directing inhibition of the combustion in the other combustion devices, to the corresponding combustion control sections. This makes it possible to reliably inhibit the combustion in the whole of the plurality of combustion devices in the common vent discharge state. Therefore, it becomes possible to reliably prevent a situation in which while one of the plurality of combustion devices is performing the combustion operation in the common vent discharge state, the operation commands for the exhaust fans of the other combustion devices do not reach the combustion devices and thereby back flow of the exhaust gas occurs. As a result, it becomes possible to properly perform a combustion inhibiting operation of each of the plurality of combustion devices if a communication abnormality (failure) between the plurality of combustion devices occurs in a case where the common exhaust passage is used for the plurality of combustion devices.

The linkage control section may be provided in at least one of the plurality of combustion devices.

The plurality of combustion devices may include exhaust fans, respectively, which send exhaust gases to exhaust passages corresponding to the plurality of combustion devices, respectively, and the linkage control section may send commands to all of the plurality of combustion devices to activate the exhaust fans, in a case where at least one of the plurality of combustion devices is performing the combustion and the information set by the setting section indicates the common vent discharge state. This makes it possible to activate the exhaust fans of all of the combustion devices and suitably prevent a back flow of the exhaust gas, in a case where at least one of the plurality of combustion devices which use the common exhaust passage is performing the combustion operation.

In accordance with the above-described aspects, in a case where a communication abnormality (failure) between the plurality of combustion devices occurs in the combustion device system in which the common exhaust passage is used for the plurality of combustion devices, it becomes possible to properly perform a combustion inhibiting operation of each of the combustion devices.

BRIEF DESCRIPTION OF THE DRAWINGS

FIG. 2 is a view showing a list of operations of combustion control sections in a case where a combustion control section of a specified combustion device of the plurality of combustion devices cannot communicate with a linkage control section, in the combustion device system of FIG. 1.

DETAILED DESCRIPTION OF THE PREFERRED EMBODIMENTS

Hereinafter, the embodiments of the present invention will be described with reference to the drawings. Throughout the drawings, the same or corresponding constituents are designated by the same reference symbols and will not be described in repetition.

Embodiment 1

Figure 1:
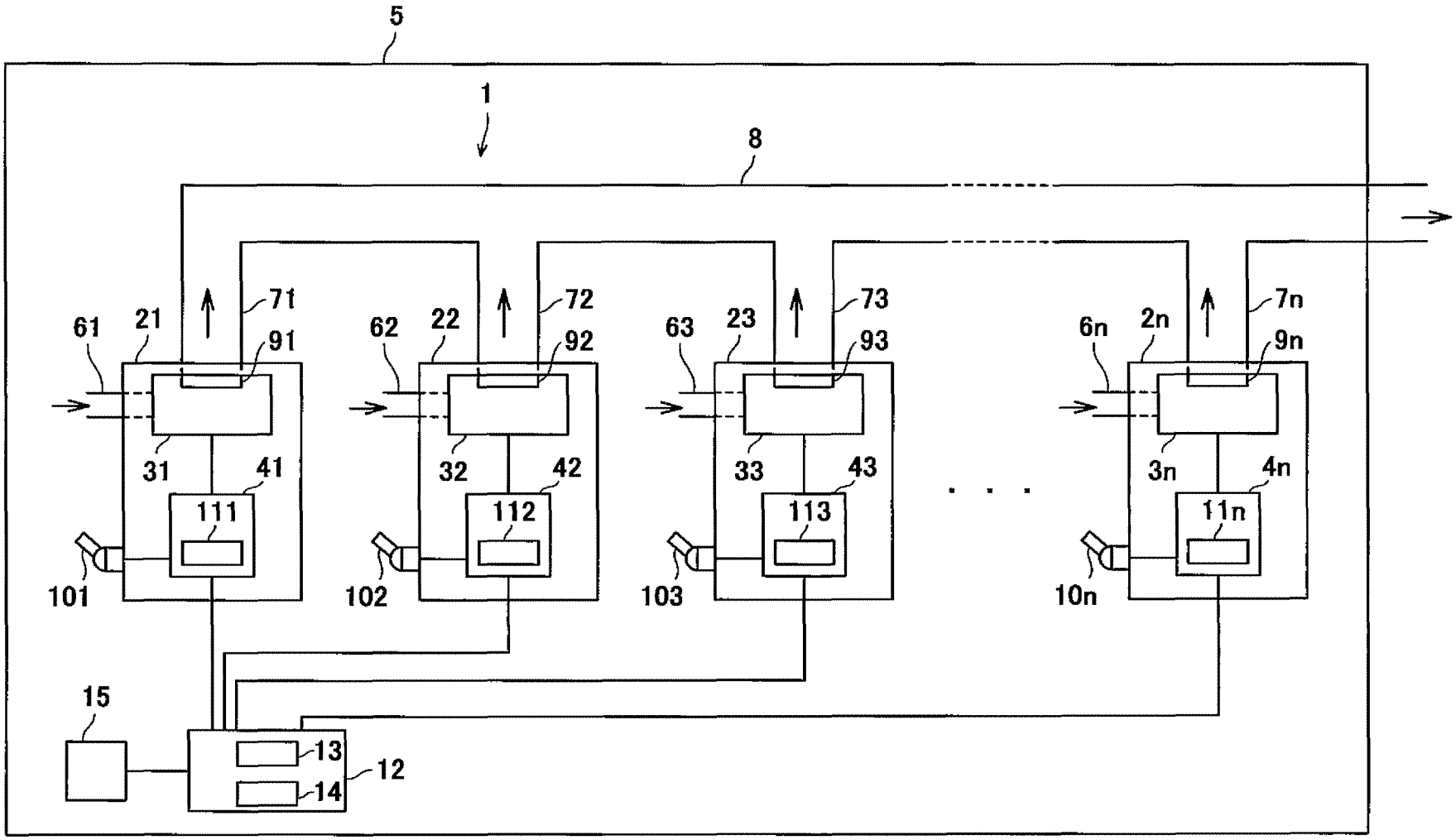
FIG. 1 is a block diagram showing the schematic configuration of a combustion device system including a plurality of combustion devices according to Embodiment 1 of the present invention.

FIG. 1 is a block diagram showing the schematic configuration of a combustion device system including a plurality of combustion devices according to Embodiment 1 of the present invention. Referring now to FIG. 1, a combustion device system 1 of the present embodiment includes a plurality of (n) combustion devices 2*i* (i=1, 2, 3, . . . , n: n 2). Each of the plurality of combustion devices 2*i* includes a combustion section 3*i* and a combustion control section 4*i* which controls combustion in the combustion section 3*i*. The combustion control section 4*i* is constituted by, for example, a microcontroller. The plurality of combustion devices 2*i* are installed in an indoor environment 5.

Each of the plurality of combustion devices 2*i* includes an intake port 6*i* through which air is taken into the combustion section 3*i* in the indoor environment 5 and an exhaust port 7*i* through which an exhaust gas generated by combustion in the combustion section 3*i* is discharged in the indoor environment 5. The exhaust ports 7*i* of the combustion devices 2*i* are connected to each other via a common duct 8. The exhaust gases generated in the combustion sections 3*i* of the combustion devices 2*i* are collectively discharged to an outdoor area through the common duct 8. In brief, the combustion device system 1 of the present embodiment is configured as a combustion device system of a common vent type in which a common exhaust passage is used for the plurality of combustion devices 2*i*. In the present embodiment, the combustion devices 2*i* in this state will be referred to as the combustion devices 2*i* in a common vent discharge state.

An exhaust fan 9*i* is disposed in the vicinity of each of the exhaust ports 7*i* to send the exhaust gas to the exhaust passage. During the operation (activated state) of the exhaust fan 9*i*, the exhaust gas generated in the corresponding combustion section 3*i* is forcibly discharged to the outdoor area through the common duct 8. In addition, by the operation of the exhaust fan 9*i*, it becomes possible to prevent a situation in which the exhaust gas in the common duct 8 flows back from the intake port 6*i* to the indoor environment 5 through the combustion section 3*i*. As the exhaust fan 9*i*, a combustion fan for introducing combustion air into the combustion section 3*i* and discharging an exhaust gas generated by combusting in the combustion section 3*i* may be used.

Each of the plurality of combustion devices 2*i* includes a setting section 10*i* operated to set information indicating whether or not the plurality of combustion devices 2*i* are in the common vent discharge state in which the common exhaust passage is used for the plurality of combustion devices 2*i*. The setting section 10*i* is constituted by, for example, a physical switch such as a DIP switch, or a virtual switch displayed on a touch panel or the like as an operation member (not shown) used to independently operate each of the plurality of combustion devices 2*i*. For example, the setting section 10*i* may be disposed inside a casing (not shown) of the combustion device 2*i* and may be mounted on a printed board (not shown) in which the combustion control section 4*i* is mounted. The information set by the setting section 10*i* is stored in a memory section (a first memory section) 11*i* provided in each of the plurality of combustion devices 2*i*. In the present embodiment, the memory section 11*i* is provided inside each of the plurality of combustion control sections 4*i*.

The combustion device system 1 includes a linkage control section 12 which controls linkage operations of the plurality of combustion control sections 4*i*. For example, the linkage control section 12 is constituted by a control section provided to connect the plurality of combustion control sections 4*i* to a common remote controller 15 operated to control the operations of the plurality of combustion devices 2*i*. The plurality of combustion control sections 4*i* are communicatively connected to each other via the linkage control section 12. The linkage control section 12 sends an operation command to each of the plurality of combustion control sections 4*i*. Each of the plurality of combustion control sections 4*i* performs a combustion operation in response to this operation command. In this way, depending on a required combustion amount (e.g., hot water amount required in the combustion devices provided in the hot water supply apparatus), the number (1 to n) of the combustion devices 2*i* which perform the combustion operations is decided. In the present embodiment, a term "communicatively connected" is meant to include a case where a specified combustion control section 4*i* is connected to the linkage control section 12 via a communication line including 2-core line or the like, a case where the specified combustion control section 4*i* is connected to the linkage control section 12 by wireless (radio) communication, a case where the combustion control section 4*i* and the linkage control section 12 are provided within the specified combustion device 2*i* and interconnected so that signals are transmitted and received between the combustion control section 4*i* and the linkage control section 12, and a case where the linkage control section 12 is provided within the specified combustion control section 4*i* (the specified combustion control section 4*i* functions as the linkage control section 12).

The linkage control section 12 includes an information obtaining section 13 which obtains the information set by the setting section 10*i* from at least one of the plurality of combustion devices 2*i*, and a memory section (a second memory section) 14 which stores therein connection configurations between the linkage control section 12 and the plurality of combustion control sections 4*i*. Although in the example of FIG. 1, the linkage control section 12 is shown as being disposed outside the plurality of combustion devices 2*i*, the linkage control section 12 may be disposed inside one of the plurality of combustion devices 2*i*. In this case, a specified combustion control section 4*i* may function as the linkage control section 12, or the linkage control section 12 may be constituted by, for example a microcontroller different from the microcontroller constituting the combustion control section 4*i*.

At a time point when the plurality of combustion devices 2*i* (the plurality of combustion control sections 4*i*) are connected to each other to construct the combustion device system 1 (in a normal state in which no abnormality is found, for example, at a time point when a power supply is initially turned on), the linkage control section 12 stores in the memory section 14 the connection configurations which are identifiers (ID numbers and the like) of the combustion control sections 4*i* connected to each other, and/or the number n or the like of the combustion devices 2*i*. In contrast, in the memory section 11*i* of each of the combustion control sections 4*i*, information indicating that this combustion control section 4*i* is connected to the linkage control section 12 is stored as the connection configuration.

In a case where at least one of the plurality of combustion devices 2*i* is performing the combustion operation, and the information set by the setting section 10*i* indicates the common vent discharge state, the linkage control section 12 sends to all of the combustion devices 2*i*, commands directing activation of the exhaust fans 9*i* of these combustion devices 2*i*. In response to the commands, the exhaust fans 9*i* of all of the combustion devices 2*i* can be activated, and a back flow of the exhaust gas can be suitably prevented, in a case where at least one of the plurality of combustion devices 2*i* which use the common exhaust passage is performing the combustion operation. On the other hand, in a case where the information set by the setting section 10*i* does not indicate the common vent discharge state, in a state in which at least one of the plurality of combustion devices 2*i* is performing the combustion operation, the linkage control section 12 need not send to all of the combustion devices 2*i*, the commands directing activation of the exhaust fans 9*i*. This is because a situation in which the exhaust gas generated in one of the combustion devices 2*i* which is performing the combustion operation flows back to the other combustion devices 2*i* is less likely to occur, in a case where the common exhaust passage is not used for the plurality of combustion devices 2*i*.

As described above, in a case where at least one of the plurality of combustion devices 2*i* is performing the combustion operation, in the combustion device system in which the common exhaust passage is realized by use of the common duct 8, it is necessary to activate the exhaust fans 9*i* of all of the combustion devices 2*i* to prevent the back flow of the exhaust gas. To this end, it is required that communications between the linkage control section 12 and the plurality of combustion control sections 4*i* be properly performed. In a conventional example, it is determined that there is a communication abnormality (failure) in a case where the combustion control sections do not communicate with each other for a predetermined period of time, even though a communication is established between the control sections after a power supply in a combustion device system is ON. However, in this example, once the power supply of the combustion device system is OFF after occurrence of the communication abnormality, the combustion device which cannot perform a communication is handled as a combustion device which is disconnected when the power supply is ON again. In this example, in a case where the common exhaust passage is not used, a problem does not occur except that the combustion device which cannot perform a communication is not performing a combustion operation. However, in a case where the common exhaust passage is used in the combustion device system 1 as described above, the back flow of the exhaust gas occurs. Therefore, the conventional determination of the communication abnormality cannot sufficiently address the back flow of the exhaust gas.

In view of this, in the present embodiment, each of the combustion control sections 4*i* determines whether or not the combustion control section 4*i* can communicate with another control section at predetermined timings. In the present embodiment, each of the combustion control sections 4*i* determines whether or not it can communicate with the linkage control section 12. In addition, the linkage control section 12 determines whether or not it can communicate with the combustion control sections 4*i* of the plurality of combustion devices 2*i* included in the connection configurations at predetermined timings. The linkage control section 12 sends an operation signal to each of the combustion control sections 4*i* at predetermined constant time intervals. Receiving the operation signal, each of the combustion control sections 4*i* sends a reply signal to the linkage control section 12 within a predetermined time. If the combustion control section 4*i* does not send the reply signal to the linkage control section 12 within the predetermined time after the linkage control section 12 has sent the operation signal to each of the combustion control sections 4*i*, the linkage control section 12 determines that it cannot communicate with this combustion control section 4*i*. Also, in a case where each of the combustion control sections 4*i* cannot receive the operation signal from the linkage control section 12, this combustion control section 4*i* determines that it cannot communicate with the linkage control section 12.

In a case where each of the combustion control sections 4*i* determines that it cannot communicate with the linkage control section 12 and the common vent discharge state is set by the setting section 10*i*, this combustion control section 4*i* inhibits the combustion in the combustion device 2*i* to which this combustion control section 4*i* belongs (the combustion in the combustion device 2*i* corresponding to this combustion control section 4*i*). For example, in a case where the combustion control section 41 determines that it cannot communicate with the linkage control section 12, the combustion control section 41 inhibits the combustion in the combustion section 31 of the combustion device 21 to which the combustion control section 41 belongs. The phrase "inhibits the combustion" indicates that the combustion operation of the combustion section 31 is ceased in a case where the combustion section 31 is performing the combustion operation, and that an operation for initiating the combustion operation is not accepted in a case where the combustion section 31 is not activated.

In accordance with the above-described configuration, in a case where a condition in which the information set by the setting section 10*i* indicates the common vent discharge state and a condition in which the combustion control section 4*i* cannot communicate with the linkage control section 12 are met, the combustion control section 4*i* of the combustion device 2*i* inhibits the combustion in the combustion device 2*i* to which this combustion control section 4*i* belongs. This makes it possible to reliably prevent a situation in which while one of the plurality of combustion devices 2*i* is performing the combustion operation in the common vent discharge state, the operation commands for the exhaust fans 9*i* in the other combustion devices 2*i* do not reach these combustion devices 2*i* and thereby back flow of the exhaust gas occurs. Therefore, it becomes possible to properly perform a combustion inhibiting operation of each of the plurality of combustion devices 2*i* if a communication abnormality (failure) between the plurality of combustion devices 2*i* occurs in a case where the common exhaust passage is used for the plurality of combustion devices 2*i*.

In a case where the linkage control section 12 determines that it cannot communicate with at least one of the plurality of combustion control sections 4*i* of the plurality of combustion devices 2*i* and the information obtained from the setting section 10*i* indicates the common vent discharge state, the linkage control section 12 sends to the combustion control sections 4*i* which can perform a communication, combustion inhibiting commands directing inhibition of the combustion in the combustion devices 2*i* corresponding to the combustion control sections 4*i* which can perform a communication.

For example, it is assumed that a communication abnormality (failure) between the combustion control section 41 of the combustion device 21 and the linkage control section 12 occurs, in a case where the information set by the setting section 10*i* indicates the common vent discharge state. This will be described in detail with reference to FIG. 2. FIG. 2 is a view showing a list of the operations of the combustion control sections 4*i* in a case where the combustion control section 41 of the combustion device 21 cannot communicate with the linkage control section 12, in the combustion device system 1 of FIG. 1. As shown in FIG. 2, the combustion control section 41 in a communication abnormality state, determines that it cannot communicate with the linkage control section 12, and inhibits the combustion of the combustion section 31 of the combustion device 21 to which the combustion control section 41 belongs. In addition, the linkage control section 12 determines that it cannot communicate with the combustion control section 41 of the combustion device 21 and sends combustion inhibiting commands to the combustion control sections (combustion control sections connected to the linkage control section 12, which are other than the combustion control section 41) 42 to 4*n* which can communicate with the linkage control section 12. Receiving the combustion inhibiting commands, the combustion control sections 42 to 4*n* inhibit the combustion in the combustion devices 22 to 2*n* to which the combustion control sections 42 to 4*n* belong.

In accordance with this, in a case where the common vent discharge state is set, the combustion control section 41 of the combustion device 21 which cannot communicate with the linkage control section 12 inhibits the combustion in the combustion device 21 to which the combustion control section 41 belongs, and the linkage control section 12 sends the combustion inhibiting commands to the combustion control sections 42 to 4*n* to inhibit the combustion in the other combustion devices 22 to 2*n*. This makes it possible to reliably inhibit the combustion in the whole of the plurality of combustion devices 2*i* in the common vent discharge state. In contact, in a case where the common vent discharge state is not set (the common exhaust passage is not used for the plurality of combustion devices 2*i*), the linkage control section 12 does not send the combustion inhibiting commands to the combustion control sections 42 to 4*n* which can communicate with the linkage control section 12. Therefore, the combustion device system 1 can continue the linkage operations of the remaining combustion devices 22 to 2*n* other than the combustion device 21 which cannot communicate with the linkage control section 12. In this way, depending on whether or not the common vent discharge state is set by the setting section 10*i*, the combustion inhibiting state in the linkage control can be optimally changed. Therefore, the configuration of the combustion device system 1 can be easily changed by, for example, changing how to discharge the exhaust gas, or shifting only one of the plurality of combustion devices 2*i* from the common vent discharge state to an independent discharge state. In this way, the use status of the combustion devices 2*i* can be flexibly changed.

Embodiment 2

Figure 3:
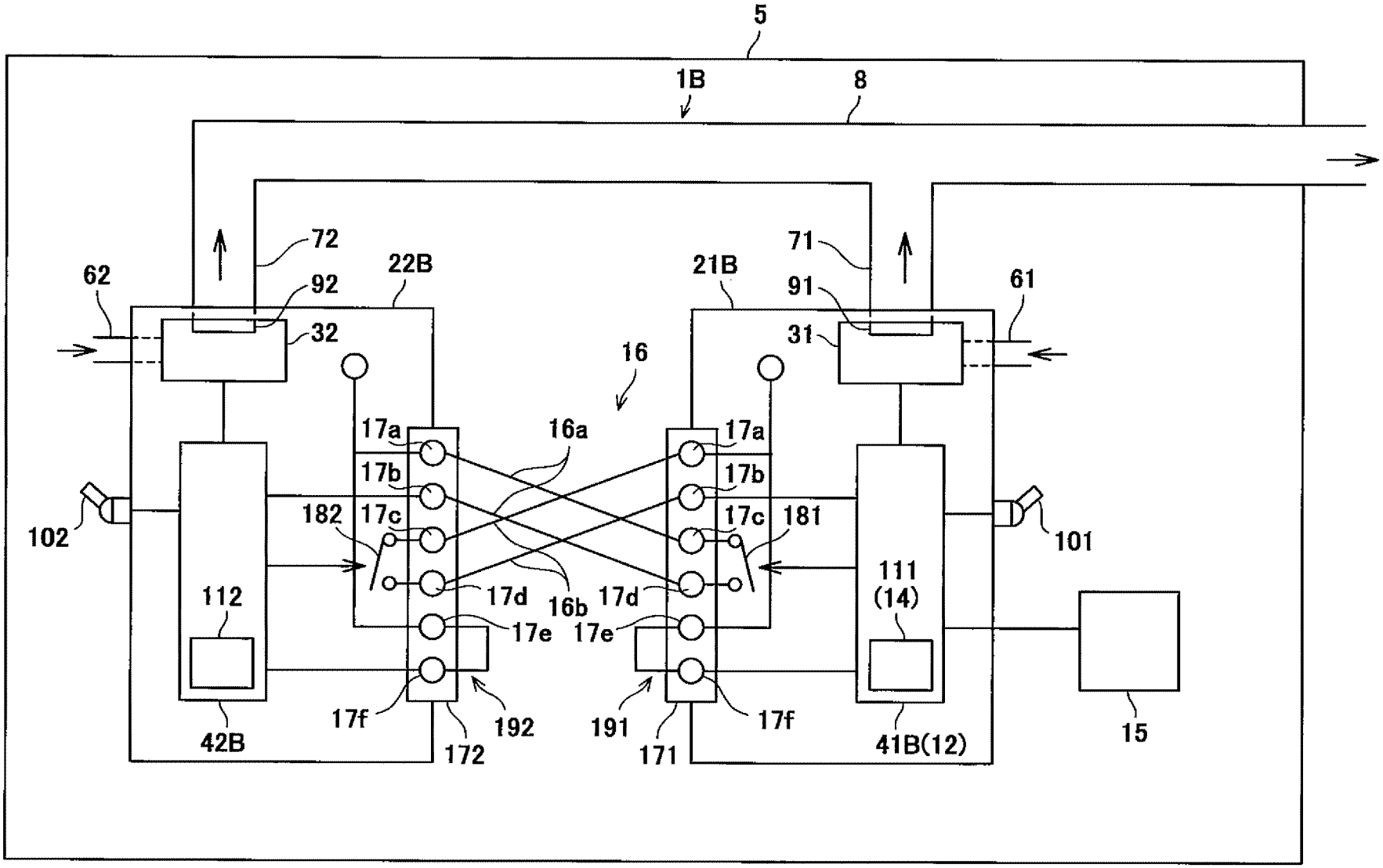
FIG. 3 is a block diagram showing the schematic configuration of a combustion device system including a plurality of combustion devices according to Embodiment 2 of the present invention.

Next, Embodiment 2 of the present invention will be described. FIG. 3 is a block diagram showing the schematic configuration of a combustion device system including a plurality of combustion devices according to Embodiment 2 of the present invention. In FIG. 3, the same constituents as those of FIG. 1 or the corresponding constituents are designated by the same reference symbols and will not be described repeatedly.

A combustion device system 1B of Embodiment 2 is different from the combustion device system 1 of Embodiment 1 in that a combustion control section (a first combustion control section) 41B which is one of a plurality of combustion control sections 41B, 42B of a plurality of combustion devices 21B, 22B functions as the linkage control section 12, and the plurality of combustion control sections 41B, 42B are communicatively coupled to each other via a communication line 16.

In the present embodiment, each of the two combustion control sections 41B, 42B of the two combustion devices 21B, 22B is configured to be capable of functioning as the linkage control section 12. For example, by inputting a setting command to one of the combustion control sections 41B, 42B, or connecting the common remote controller 15 to one of the combustion control sections 41B, 42B, the combustion control section which functions as the linkage control section 12 is set. In this way, the combustion device system 1B of the present embodiment is configured to perform a master-slave linkage control in such a manner that the combustion control section 41B which functions as the linkage control section 12 becomes a master control section and the combustion control section 42B becomes a slave control section (a second combustion control section). The number of the combustion control section 42B which functions as the slave control section may be one as shown in FIG. 3, or more than one. Note that the combustion control section 41B which functions as the linkage control section 12 may also function as the information obtaining section 13 which obtains the information set by the setting section 101 of the combustion device 21.

In the present embodiment, the communication line 16 includes first communication lines 16*a* via which the combustion control section 41B (master control section) sends a signal to the combustion control section 42B (slave control section) and second communication lines 16*b* which are different from the first communication lines 16*a* and via which the slave control section 42B sends a signal to the master control section 41B.

In the present embodiment, the communication line 16 is configured as external four-core cable. The combustion control sections 41B, 42B include connectors 171, 172, respectively, to provide connection of the communication line 16. Each of the connectors 171, 172 includes six terminals 17*a* to 17*f*. The combustion device 21B includes a signal output section 181 which outputs a command from the combustion control section 41B as a signal. The combustion device 22B includes a signal output section 182 which outputs a command from the combustion control section 42B as a signal. The signal output sections 181, 182 are constituted by, for example, photo couplers, respectively. The signals output from the signal output sections 181, 182 are output to an outside area through the connectors 171, 172, respectively.

A power-supply voltage line of the combustion device 22B is connected to the first terminal 17*a* of the connector 172 of the combustion device 22B to supply a power-supply voltage to a power wire of the first communication line 16*a*. The power wire of the first communication line 16*a* is connected to a first end of the signal output section 181 via the third terminal 17*c* of the connector 171 of the combustion device 21B. A second end of the signal output section 181 is connected to a signal line of the first communication line 16*a* via the fourth terminal 17*d* of the connector 171. The signal line of the first communication line 16*a* is connected to the slave control section 42B via the second terminal 17*b* of the connector 172. In this configuration, the signal output from the master control section 41B via the signal output section 181 is input to the slave control section 42B via the signal line of the first communication line 16*a*.

Likewise, a power-supply voltage line of the combustion device 21B is connected to the first terminal 17*a* of the connector 171 of the combustion device 21B to supply a power-supply voltage to a power wire of the second communication line 16*b*. The power wire of the second communication line 16*b* is connected to a first end of the signal output section 182 via the third terminal 17*c* of the connector 172 of the combustion device 22B. A second end of the signal output section 182 is connected to a signal line of the second communication line 16*b* via the fourth terminal 17*d* of the connector 172. The signal line of the second communication line 16*b* is connected to the master control section 41B via the second terminal 17*b* of the connector 171. In this configuration, the signal output from the slave control section 42B via the signal output section 182 is input to the master control section 41B via the signal line of the second communication line 16*b*.

In the master-slave combustion device system 1B, the master control section 41B sends the operation signal to the slave control section 42B at predetermined time intervals, while the slave control section 42B sends a reply signal within a predetermined time in a case where the slave control section 42B receives the operation signal. In a case where the slave control section 42B does not send the reply signal to the master control section 41B within the predetermined time after the master control section 41B has sent the operation signal to the slave control section 42B, the master control section 41B determines that it cannot communicate with the slave control section 42B. Also, in a case where the slave control section 42B determines that it cannot receive the operation signal from the master control section 41B, the slave control section 42B determines that it cannot communicate with the master control section 41B.

The fifth terminal 17*e* and the sixth terminal 17*f* of the connector 171 are short-circuited when the communication line 16 is connected to the connector 171. The power-supply voltage line of the combustion device 21B is connected to the fifth terminal 17*e*, and the master control section 41B is connected to the sixth terminal 17*f*. Therefore, in a case where the communication line 16 is connected to the connector 171, the power-supply voltage is input to the master control section 41B, and the fifth terminal 17*e* and the sixth terminal 17*f* of the connector 171 function as a connection detection section 191 which detects a connection of the communication line 16. Likewise, the fifth terminal 17*e* and the sixth terminal 17*f* of the connector 172 function as a connection detection section 192 of the slave control section 42B. The connection detection sections 191, 192 function as physical memory sections, for storing the connection configuration between the master control section 41B and the slave control section 42B.

In the above-described configuration, the master control section 41B determines whether or not it can communicate with the slave control section 42B, and inhibits the combustion in the combustion device 21B to which the master control section 41B belongs, in a case where the master control section 41B determines that it cannot communicate with the slave control section 42B and the common vent discharge state is set by the setting section 101. Also, the slave control section 42B determines whether or not it can communicate with the master control section 41B which functions as the linkage control section 12, and inhibits the combustion in the combustion device 22B to which the slave control section 42B belongs, in a case where the slave control section 42B determines that it cannot communicate with the master control section 41B and the common vent discharge state is set by the setting section 102.

In the master-slave combustion device system 1B of the present embodiment, it becomes possible to reliably prevent a situation in which while one of the plurality of combustion devices 21B, 22B is performing the combustion operation in the common vent discharge state, the operation command for the exhaust fan 91 or 92 of the other combustion device 21B or 22B does not reach this combustion device 21B or 22B, and thereby back flow of the exhaust gas occurs. Therefore, it becomes possible to properly perform a combustion inhibiting operation of each of the plurality of combustion devices 21B, 22B if a communication abnormality (failure) between the plurality of combustion devices 21B, 22B occurs in a case where the common exhaust passage is used for the plurality of combustion devices 21B, 22B.

In a case where the master control section 41B cannot receive the reply signal from the slave control section 42B within a predetermined time after the master control section 41B has sent the signal to the slave control section 42B, the master control section 41B inhibits the combustion in the combustion device 21B to which the master control section 41B belongs, and sends a combustion inhibiting command to the slave control section 42B.

In this configuration, in the case of occurrence of a communication abnormality (failure), the master control section 41B which cannot receive the signal and can send the signal inhibits the combustion in the combustion device 22B corresponding to the slave control section 42B to which the master control section 41B can send the signal, as well as the combustion in the combustion device 21B to which the master control section 41B belongs. In this way, the combustion in both of the combustion devices 21B, 22B can be properly inhibited.

Thus far, the embodiments of the present invention have been described. The present invention is not limited to the above-described embodiments, and can be improved, change or modified within the scope of the invention.

For example, a back flow prevention mechanism such as a back flow damper may be provided in the vicinity of the exhaust port 7*i* of each of the combustion devices, 2*i*, 21B, 22B. The back flow prevention mechanism is capable of preventing the exhaust gas in the common duct 8 from flowing back through the exhaust port 7*i* without operating the exhaust fan 9*i*. However, in some cases, the back flow prevention mechanism may fail to function due to a damage or the like. In view of this, the above-described embodiments which can inhibit the combustion in all of the combustion devices 2*i* which uses the common exhaust passage, in the case of occurrence of the communication abnormality (failure), can also be effectively used in the combustion device system including the back flow prevention mechanism.

[Example of Application to Hot Water Supply Apparatus]

Figure 4:
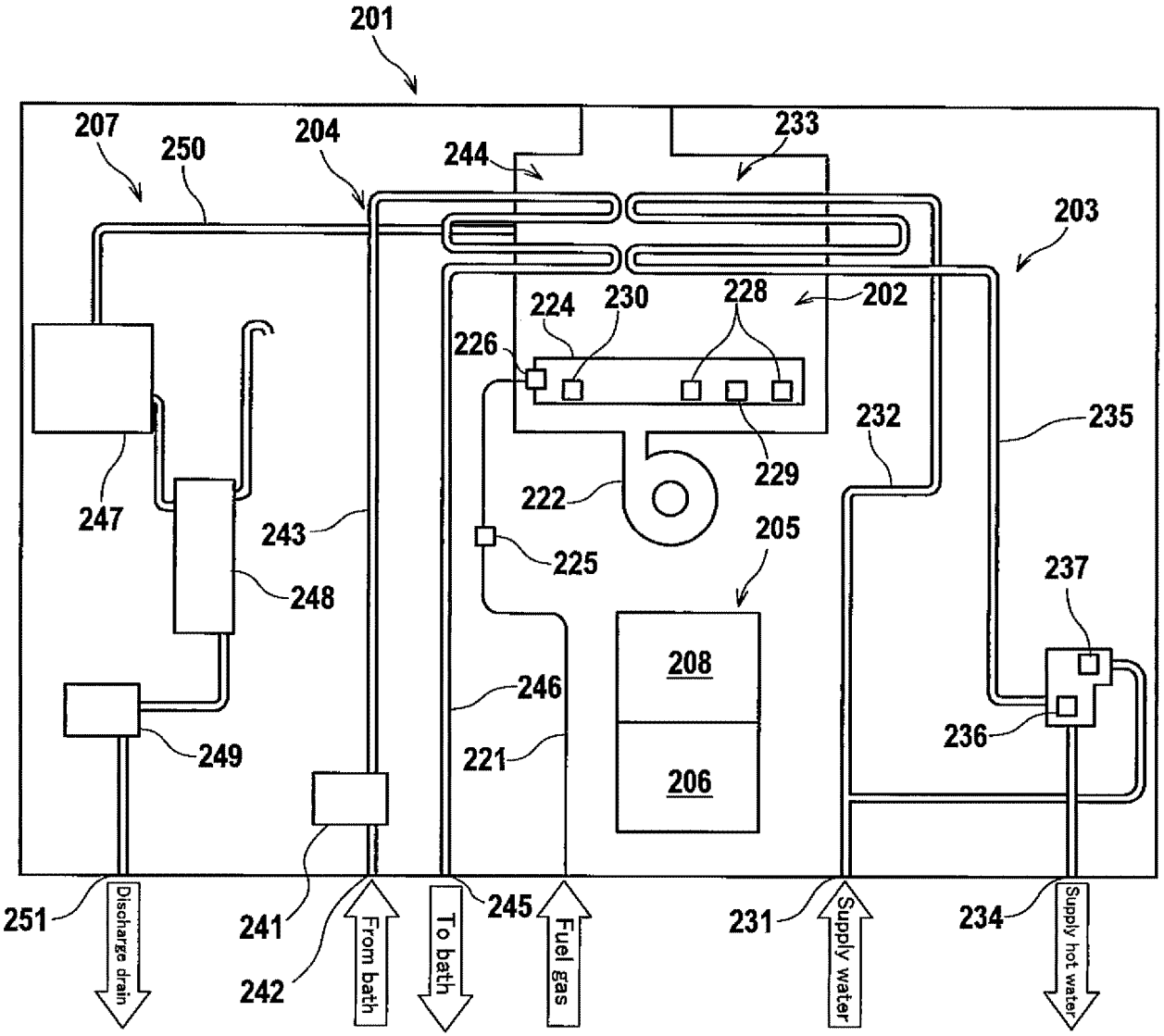
FIG. 4 is a view showing the principle of the operation of an example of a hot water supply apparatus incorporating the combustion devices of Embodiment 1 and Embodiment 2.

Next, an example of a hot water supply apparatus incorporating the combustion devices 2*i*, 21B, 22B included in the combustion device systems 1, 1B will be described. FIG. 4 is a view showing the principle of operation of an example of the hot water supply apparatus 201 incorporating the combustion devices 2*i*, 21B, 22B of Embodiment 1 and Embodiment 2. Referring now to FIG. 4, the hot water supply apparatus 201 is a multi-function hot water supply apparatus including a hot water supply function and a reheating (additional heating) function. The hot water supply apparatus 201 includes a combustion device 202 which combusts a fuel gas, a fuel gas supply passage 221 used to supply the fuel gas to the combustion device 202, a blower (fan) 222 which supplies air to the combustion device 202, a hot water supply passage 203, a reheating passage 204, a bath pump 241 provided at the reheating passage 204, and a controller 205. The hot water supply apparatus 201 further includes a drain recovery mechanism 207 which recovers a drain generated by recovering latent heat generated in the combustion device 202. In FIG. 4, sensors such as an input water temperature sensor and an output hot water temperature sensor in the hot water supply passage 203 are omitted. Also, in FIG. 4, a bathtub hot water feeding passage which branches from the hot water supply passage 203 and is connected to the reheating passage 204, and a hot water feeding opening/closing valve provided at the bathtub hot water feeding passage are omitted.

The combustion device 202 is provided with a burner unit 224. The fuel gas is supplied to the burner unit 224 through the fuel gas supply passage 221. The fuel gas supply passage 221 is provided with an original gas electromagnetic valve 225 which performs switching between supply and non-supply of the fuel gas, and a gas proportional valve 226 which adjusts the supply amount of the fuel gas. The burner unit 224 is provided with a bath gas electromagnetic valve 230, a plurality of hot water supply switching gas electromagnetic valves 228, and a hot water supply gas electromagnetic valve 229.

The hot water supply passage 203 includes a pipe constituting a water delivery section 232 which delivers the water supplied from a tap water or the like from a water inlet 231 to a hot water supply heat exchange section 233 (described later), the hot water supply heat exchange section 233 which heats the water by heat exchange between the water and a combustion gas generated in the combustion device 202, and a hot water delivery section 235 which delivers the hot water from the hot water supply heat exchange section 233 to a hot water outlet 234. The hot water delivery section 235 is provided with a hot water supply amount control valve 236 which controls a hot water supply amount, and a mixing valve 237 which adjusts a mixing ratio between the water and the hot water to adjust the amount and temperature of the hot water.

The reheating passage 204 includes a pipe constituting a return section 243 which sends bath water from a return port 242 to a reheating heat exchange section 244 which will be described later, the reheating heat exchange section 244 which heats the bath water by heat exchange between the bath water and the combustion gas generated in the combustion device 202, and an outward section 246 which sends the heated bath water from the reheating heat exchange section 244 to an outward port 245. The bath pump 241 is provided at the return section 243 of the reheating passage 204.

The drain recovery mechanism 207 includes a drain discharge passage 250 through which condensed water flows, the condensed water being generated by condensing steam in the combustion gas generated in the hot water supply heat exchange section 233 and the reheating heat exchange section 244, a neutralization container 247 which neutralizes the condensed water, a drain tank 248 which temporarily stores (reserves) therein the neutralized condensed water, and a drain pump 249 which discharges the condensed water stored in the drain tank 248 to an outside area through a drain port 251.

Each of the blower 222, the bath pump 241, and the drain pump 249 includes a DC motor as a driving unit. The bath pump 241 and the drain pump 249 are configured as squeeze pumps which forcibly flow the hot water or the drain through the pipe. The bath pump 241 and the drain pump 249 have a predetermined allowable operation voltage range including DC 141V.

The controller 205 includes a control device 208 and a switching power supply device 206 (hereinafter will also be expressed as "power supply device 206"). The control device 208 includes a microcontroller or an integrated circuit including CPU, ROM, RAM, and others. The control device 208 corresponds to the combustion control sections 4*i*, 41B, 42B of the above-described embodiments.

The control device 208 is provided with signal paths (not shown) between the control device 208 and the electric devices such as the blower 222, the bath pump 241 and the drain pump 249. The controller 205 executes controls for the hot water supply apparatus 201 according to control programs stored in the control device 208. The control programs include programs associated with the operations of the electric devices. By executing these control programs, the controller 205 controls the electric devices.

Electric power is supplied from an external power supply (not shown) to the controller 205. The power supply device 206 generates electric power (e.g., DC 141V for driving the pumps or DC 15V for driving other devices) used in the hot water supply apparatus 201. The power supply device 206 converts these voltages into desired ones and supplies the voltages to the electric devices such as the control device 208, the combustion device 202, the blower 222, the bath pump 241, the drain pump 249, the electromagnetic valves, the sensors and others.

The combustion devices of the above-described embodiments are applicable to the hot water supply apparatus having at least one of the hot water supply function, the bath reheating function, and a hot water air heating function, for example, a hot water supply apparatus having the hot water air heating function, in addition to the hot water supply function and the bath reheating function of the hot water supply apparatus 201.

As the combustion device 202 of the hot water supply apparatus 201 described above, the plurality of combustion devices 2*i* or 21B, 22B of the above-described embodiments in the combustion device system 1, 1B may be used. In this case, the control device 208 of the hot water supply apparatus 201 in the present example corresponds to the combustion control sections 2*i*, 21B, 22B of the above-described embodiments, while the blower 222 corresponds to the exhaust fan 9*i* of the above-described embodiments. In this configuration, it becomes possible to properly perform the combustion inhibiting operations of the combustion devices in a case where the communication abnormality (failure) state between the plurality of combustion devices occurs in the combustion device system in which the common exhaust passage is used for the plurality of combustion devices.

A combustion device and a combustion device system of the present invention are effectively used to perform combustion inhibiting operations of a plurality of combustion devices in a case where a communication abnormality (failure) between the plurality of combustion devices occurs in the combustion device system in which a common exhaust passage is used for the plurality of combustion devices.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A combustion device included in a plurality of combustion devices used in a combustion device system in which a plurality of combustion control sections of the plurality of combustion devices are communicatively connected to each other via a linkage control section which controls linkage operations of the plurality of combustion devices, and a common exhaust passage can be used for the plurality of combustion devices, the combustion device comprising:

the combustion control section which controls combustion in the combustion device to which the combustion control section belongs;

a setting section operated to set information indicating whether or not the plurality of combustion devices are in a common vent discharge state in which the common exhaust passage is used for the plurality of combustion devices; and a first memory section which stores therein connection configurations between the combustion control section and the other combustion control sections to which the combustion control section is communicatively connected, wherein the combustion control section determines whether or not the combustion control section can communicate with the linkage control section or the other combustion control sections, and inhibits combustion in the combustion device to which the combustion control section belongs, in a case where the combustion control section determines that the combustion control section cannot communicate with the linkage control section or at least one of the other combustion control sections and the common vent discharge state is set by the setting section, wherein the linkage control section includes:

an information obtaining section which obtains the information set by the setting section from at least one of the plurality of combustion devices; and a second memory section which stores therein connection configurations between the linkage control section and the plurality of combustion control sections, wherein the linkage control section determines whether or not the linkage control section can communicate with each of the plurality of combustion control sections of the plurality of combustion devices, and sends to the combustion control sections being in communication with the linkage control section, combustion inhibiting commands directing inhibition of combustion in the combustion devices corresponding to the combustion control sections being in communication with the linkage control section, in a case where the linkage control section determines that the linkage control section cannot communicate with at least one of the plurality of combustion control sections and the information obtained from the setting section indicates the common vent discharge state, and wherein the combustion control sections being in communication with the linkage control section inhibit the combustion in the combustion devices to which the combustion control sections belong, in response to the combustion inhibiting commands received from the linkage control section.

2. The combustion device according to claim 1, wherein a first combustion control section which is one of the plurality of combustion control sections is configured to function as the linkage control section, wherein the plurality of combustion control sections are communicatively connected to each other via a communication line, wherein the communication line includes a first communication line used to send a signal from the first combustion control section to a second combustion control section which is another of the plurality of combustion control sections, and a second communication line which is different from the first communication line and is used to send the signal from the second combustion control section to the first combustion control section, and wherein the first combustion control section inhibits the combustion in the combustion device to which the first combustion control section belongs and sends the combustion inhibiting command to the second combustion control section, in a case where the first combustion control section cannot receive the signal from the second combustion control section within a predetermined time period after the first combustion control section has sent the signal to the second combustion control section.

3. A combustion device system in which a plurality of combustion control sections of a plurality of combustion devices are communicatively connected to each other via a linkage control section which controls linkage operations of the plurality of combustion devices, and a common exhaust passage can be used for the plurality of combustion devices, the combustion device system comprising:

the plurality of combustion control sections which are provided in the plurality of combustion devices, respectively, and control combustion in the plurality of combustion devices;

the linkage control section communicatively connected to the plurality of combustion control sections; and a setting section provided in each of the plurality of combustion devices and operated to set information indicating whether or not the plurality of combustion devices are in a common vent discharge state in which the common exhaust passage is used for the plurality of combustion devices, wherein the linkage control section includes:

an information obtaining section which obtains the information set by the setting section from at least one of the plurality of combustion devices; and a second memory section which stores therein connection configurations between the linkage control section and the plurality of combustion control sections of the plurality of combustion devices, wherein the linkage control section determines whether or not the linkage control section can communicate with each of the plurality of combustion control sections of the plurality of combustion devices, and sends to the combustion control sections being in communication with the linkage control section, combustion inhibiting commands directing inhibition of combustion in the combustion devices corresponding to the combustion control sections being in communication with the linkage control section, in a case where the linkage control section determines that the linkage control section cannot communicate with at least one of the plurality of combustion control sections of the plurality of combustion devices and the information obtained from the setting section indicates the common vent discharge state, and wherein the combustion control section of each of the plurality of combustion devices determines whether or not the combustion control section can communicate with the linkage control section or the other combustion control sections, and inhibits combustion in the combustion device to which the combustion control section belongs, in a case where the combustion control section determines that the combustion control section cannot communicate with the linkage control section or at least one of the other combustion control sections and the common vent discharge state is set by the setting section, or a case where the combustion control section receives the combustion inhibiting command from the linkage control section.

4. The combustion device system according to claim 3, wherein the linkage control section is provided in at least one of the plurality of combustion devices.

5. The combustion device system according to claim 4, wherein the plurality of combustion devices include exhaust fans, respectively, which send exhaust gases to exhaust passages corresponding to the plurality of combustion devices, respectively, and wherein the linkage control section sends commands to all of the plurality of combustion devices to activate the exhaust fans, in a case where at least one of the plurality of combustion devices is performing the combustion and the information set by the setting section indicates the common vent discharge state.

6. The combustion device system according to claim 3, wherein the plurality of combustion devices include exhaust fans, respectively, which send exhaust gases to exhaust passages corresponding to the plurality of combustion devices, respectively, and wherein the linkage control section sends commands to all of the plurality of combustion devices to activate the exhaust fans, in a case where at least one of the plurality of combustion devices is performing the combustion and the information set by the setting section indicates the common vent discharge state.

* * * * *